United States Patent [19]

Parsons

[11] 4,165,706

[45] Aug. 28, 1979

[54] SUBMERSIBLE VEHICLE DEPLOYMENT AND RECOVERY SYSTEM FOR ROUGH WATER

[75] Inventor: John S. Parsons, Mission Viejo, Calif.

[73] Assignee: Global Marine, Inc., Los Angeles, Calif.

[21] Appl. No.: 898,669

[22] Filed: Apr. 21, 1978

[51] Int. Cl.[2] ..... B63B 35/44

[52] U.S. Cl. ..... 114/258; 114/48; 405/185

[58] Field of Search ..... 114/44, 48, 49, 50, 114/258, 264, 312, 314, 318, 66; 214/15 R, 12; 405/185, 188, 189, 190, 191, 194, 196

[56] References Cited

U.S. PATENT DOCUMENTS

| | | | |
|---|---|---|---|
| 1,823,965 | 9/1931 | Adler | 405/194 |
| 3,507,241 | 4/1970 | Southerland et al. | 114/258 |
| 3,641,961 | 2/1972 | Howard | 114/264 |
| 3,894,640 | 7/1975 | Crooke et al. | 114/264 |

*Primary Examiner*—Jesus D. Sotelo

*Attorney, Agent, or Firm*—Christie, Parker & Hale

[57] ABSTRACT

A heavy submersible object is deployed from or retrieved to a floating vessel in rough water. The connection or release point is sufficiently far below the water surface that surface waves have little if any effect on the object. Deployment and retrieval are made to an arm which depends from the vessel and which has a variable stiffness connection, ranging from free-swinging to rigid, to the vessel. Deployment and retrieval are made with the arm free-swinging from the vessel so the arm has no motion due to pitch or roll of the vessel. In retrieval, the connection is progressively stiffened to rigid after the object has been connected to the arm, and the arm is then raised with the retrieved object.

13 Claims, 5 Drawing Figures

Fig. 2
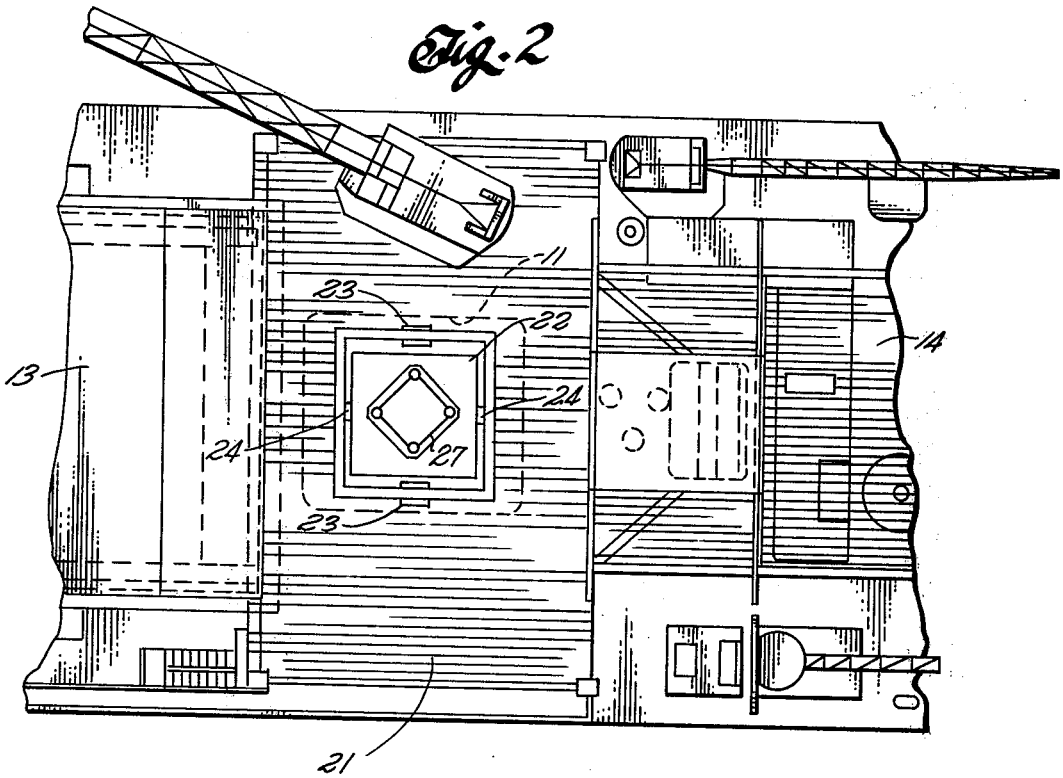
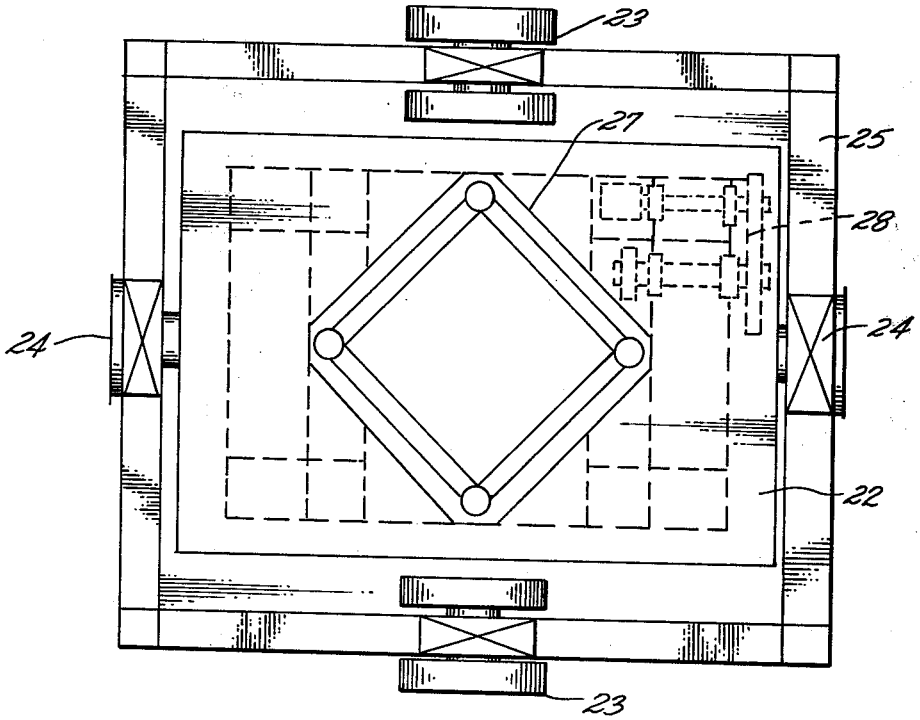
Fig. 3

SUBMERSIBLE VEHICLE DEPLOYMENT AND RECOVERY SYSTEM FOR ROUGH WATER

BACKGROUND OF THE INVENTION

1. Field of the Invention:

This invention pertains to systems for deploying and retrieving submersible objects, such as diving bells or the like, from and to floating vessels. More particularly, it pertains to such systems useful to safely perform such operations in rough water where the floating vessel experiences appreciable pitch, heave and roll motions.

2. Review of the Prior Art and the Problems Thereof:

Subsea pipelaying operations require, in the case of long pipelines, that connections be made periodically between sections of pipeline. These connections are made, preferably by welding, on the sea floor. Subsea pipeline welds can be made by divers working directly on the sea floor if water depths are not too great, but even in modest water depths such welds or other activities may take extended time to accomplish. It is not uncommon for subsea pipelaying to involve three days of diving operations for each day of actual pipelaying operation.

The time required to make welded connections between the adjacent ends of subsea pipeline sections can be reduced, and the depth at which such operations are done increased, by the use of subsea habitats installed on the sea floor where the work is to be done. The adjacent ends of the pipeline sections extend into the interior of the habitat where the necessary work can be done at substantially one atmosphere. U.S. Pat. No. 3,641,777 describes various subsea habitats useful in making subsea pipeline welded connections. Workers are moved between a surface pipelaying or other work vessel and the habitat by diving bells and the like.

It is well known that the dynamic effects of surface wave action in an ocean, for example, decrease proceeding downwardly from the ocean surface until, at a depth related to the surface wave length, no dynamic effects are encountered. Above this depth, the orbital motions of water particles increase exponentially to a maximum at the water surface; see FIG. 9.D at page 161, Hydrodynamics in Ship Design, Vol. I, by Harold E. Saunders, Society of Naval Architects and Marine Engineers, 1957. Thus, storms raging over the ocean surface may have no effect on the ocean floor if the water depth is sufficiently great, and pipeline connection activities can be performed safely at the ocean floor even though the vessels above the work location may be experiencing substantial heaving, pitching and rolling motions due to wave action at the surface. Such vessel motions have heretofore restricted the movement of bells and the like between surface vessels and subsea work habitats. These restrictions arise due to the difficulties presented in safely coupling and decoupling bells and the like to the surface vessels while the vessels move in response to wave action. Therefore, diving operations, even by the use of bells and subsea work habitats, in support of subsea pipelaying operations are restricted to periods of relatively calm surface conditions. In some areas, such as the North Sea, such relatively calm surface conditions may be few and far between each other.

it has therefore been proposed to make the connection or disconnection between a surface pipelaying vessel and the like and a diving bell at a sufficient depth below the vessel that the hazardous dynamic effects of surface wave action are avoided or sufficiently reduced to present no unacceptable hazard. Such proposals are illustrated by the systems described in U.S. Pat. Nos. 3,507,241 and 3,641,961. In both of these systems a structure extends downwardly from a floating vessel to a depth where surface wave action is minimal or not present, and the connection between the vessel and a bell (U.S. Pat. No. 3,641,961) or a submersible vehicle (U.S. Pat. No. 3,507,241) is made or unmade. The intent is to make or unmake the connection under conditions where the bell or vehicle is not subjected to displacements by surface wave action. In these systems, however, the structures carried by the floating vessels are effectively rigid to the floating vessels and therefore move with the floating vessels. Another system having below-vessel object deployment and retrieval structures stiffly connected to the vessel is described in U.S. Pat. No. 3,894,640. Thus, while the bells, submersible vehicles or other objects are undisturbed by wave action at the desired connection depths, th structures to which they are to be connected, or from which they are to be released, are not similarly undisturbed. Therefore, these prior arrangements, while enabling submersible object deployment and recovery in other than very calm conditions, are not safely useful in rougher and more adverse surface conditions.

U.S. Pat. No. 1,823,965 describes an arrangement for providing a water-free vertical path between a submerged location and a surface vessel through which a man may move, as by climbing a ladder. In this arrangement, a vertical tubular caisson is provided between the surface vessel and the submerged location. Axially open pumps in the caisson generate a vortex in the water in the caisson, and the ladder extends vertically in the water-free vortex center along the length of the caisson. The upper end of the caisson is described to be gimballed to the surface vessel so that the caisson may be vertical even though the surface vessel may pitch and roll.

In the context of deployment and retrieval of submersible objects, such as diving bells and submersible vehicles, from and to floating vessels, such as pipelaying ships, it is seen that a need exists for improved systems which enable deployment and retrieval operations to be carried out safely under rougher and more adverse surface conditions than has heretofore been possible. The present invention is addressed to this need.

SUMMARY OF THE INVENTION

The present invention responds to the need identified above. It provides a system which substantially extends the range of sea surface conditions under which submersible object deployment and retrieval operations can be performed safely. The novel aspects of the present system involve structures and procedures. The system is useful in support of subsea pipelaying operations and is described in that context which is the presently preferred use of the invention. It will be appreciated quite readily, however, that the present system has other areas of use, such as the deployment and retrieval of submersible self-propelled rescue and research vehicles.

Generally speaking, in terms of structure, this invention provides apparatus for deploying and retrieving a heavy submersible object from and to a floating vessel. The apparatus comprises arm means which are carried by the vessel and which are movable relative to the vessel between a lowered position, in which the arm means extends vertically of the vessel to a point a selected distance below the vessel, and a raised position. Gimbal means connect the arm means to the vessel for enabling the arm means, at least in the lowered position thereof, to assume and to maintain a substantially stable attitude despite rolling and pitching motions of the vessel. Latch means are coupled to the arm means. The latch means are cooperable with an object to be deployed or retrieved for coupling the object substantially fixedly to the latch means. Lift means are operable for raising and lowering the latch means and an object coupled to the latch means relative to the vessel from and to the lower extent of said selected distance. Further, the apparatus includes snubbing means which are associated with the arm means and are selectively operable for effectively securing the arm means from angular movement thereof relative to the vessel.

The submersible object may be a diving bell or the like useful to transfer personnel from the floating vessel to a submerged habitat where welded connections between adjacent ends of subsea pipeline sections may be made. The submersible object may be a self-propelled marine research or rescue vehicle.

In a presently preferred embodiment of the invention, the arm means is a vertically extendible, fixed-length arm which is carried in a platform gimballed to the vessel. The arm is movable along its length relative to the platform. The snubbing means are associated with the platform. In one condition of the snubbing means, the platform is free to move relative to the vessel to maintain a stable, substantially horizontal position. The snubbing means has another operative condition in which the platform is constrained to move with the vessel in pitch and roll.

Procedurally, this invention provides a method for deploying and retrieving a submersible object from and to a floating vessel. This method includes, for retrieval of the object, the step of disposing at a selected distance below the vessel an object connector which is capable of supporting at least the immersed weight of the object and which is operable for releasably engaging the object substantially fixedly thereto. The method includes the step of providing a variable stiffness connection between the connector and the vessel. This connection has a first state in which the connection is sufficiently free that the connector can be positionally stable irrespective of the roll and pitch motions of the vessel, and a second state in which the connection is sufficiently stiff that the connector follows substantially exactly vessel motions in roll and pitch. The method includes the step of engaging the object to the connector while the connector is disposed at its selected distance below the vessel and the connection is in its first state. The method includes the step of operating the connection from its first to its second state and raising the connector, with the object engaged thereto, to the vessel. The procedures for deploying the object from the vessel are substantially the reverse of the latter steps described above performed in substantially the reverse order.

Stated even more broadly, this invention advances the art of deployment and retrieval of heavy submersible objects from a floating vessel in rough water. It does so by making and breaking the connection between the object and the vessel at sufficient depth below the vessel hull that the effects of wave action on the submersible object are minimal or nonexistent. This is done while the vessel-mounted connection structure is free to move relative to the hull so as to be unaffected by vessel roll and pitching motions. After the submersible object has been recovered to the connection structure at the desired depth below the vessel, the coupling between this structure and the vessel is gradually stiffened so that the object is gradually brought into synchronism with vessel motions due to wave action. The object can thereafter be raised to the water surface. In this manner, this invention avoids any short-term transitions between the motions of the vessel due to pitch or roll as it floats on the water surface and the relatively undisturbed state of the object as it exists at a sufficient depth below the water surface to be essentially free of wave action. This results in enhanced safety to personnel in the submersible object, and avoids the difficulties of trying to make a connection between the submerged object and a connector lowered from the vessel but fixed relative to the vessel so as to reflect the vessel's pitch and roll motions.

DESCRIPTION OF THE ACCOMPANYING DRAWINGS

The above-mentioned and other features of this invention are more fully set forth in the following detailed description of a presently preferred embodiment of this invention, which description is presented with reference to the accompanying drawings, wherein:

FIG. 2 is a fragmentary top plan view of a central portion of the ship shown in FIG. 1;

FIG. 3 is an enlarged plan view, in the nature of a schematic diagram, showing a gimballed platform which is illustrated in the central portion of FIG. 2.

DESCRIPTION OF THE ILLUSTRATED EMBODIMENTS

Figure 1:
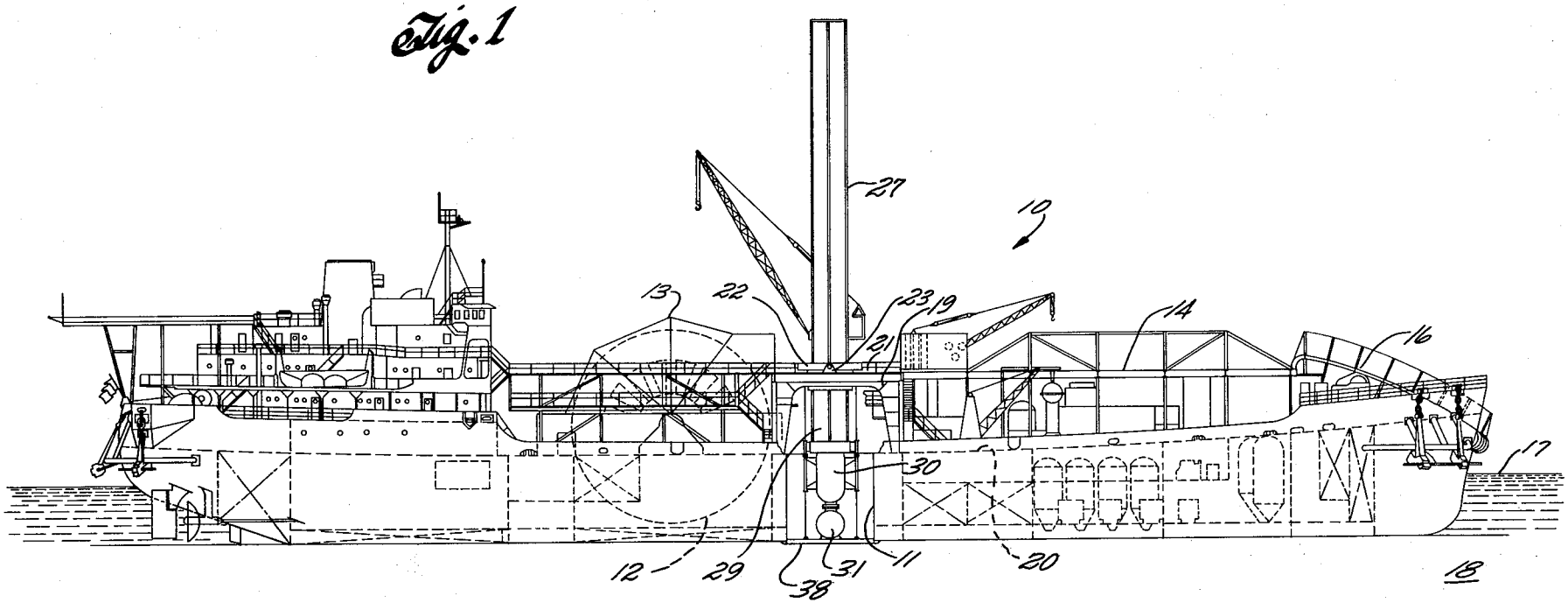
FIG. 1 is a side elevation view of a pipelaying ship.

A pipelaying ship 10 has a well 11 formed vertically through it on its centerline at about midships, as shown in FIG. 1. A pipeline storage reel 12 is located aft of well 11 in a suitable housing 13. During pipelaying, pipeline is unreeled from reel 12 and passed forwardly along a superstructure deck 14 where appropriate operations are performed upon the pipeline. The pipeline is then fed from the ship through a guide shoe 16 formed through the bow of the ship and then through the surface 17 of a sea or ocean 18 along the bed of which the pipeline is to be laid.

As shown in FIG. 1, a foundation 19 is erected on the main deck 20 of the ship for supporting a portion 21 of the superstructure deck 14. A platform 22 is supported on foundation 19 by outer and inner gimbals 23 and 24, which are shown best in FIGS. 2 and 3. Outer gimbals 23 support a gimbal ring 25 to foundation 19 so that the gimbal ring is angularly movable relative to the vessel about a transverse horizontal axis along which gimbals 23 are located. Inner gimbals 24 are coaxially aligned along the forward and rear portions of gimbal ring 25 for supporting platform 22 within the gimbal ring. Inner gimbals 24 mount the platform for angular motion relative to the gimbal ring about a substantially horizontal fore-and-aft axis along which the inner gimbals are aligned. It is therefore apparent that platform 22, by virtue of its double-gimballed mounting to vessel 10, is capable of assuming and maintaining a stable horizontal position despite rolling and pitching motions of the ship in response to waves moving across ocean surface 17.

As shown in FIGS. 1 and 2, platform 22 is aligned over the center of well 11.

Also as shown in FIGS. 1 and 2, an elongate, substantially rigid, fixed-length arm 27 is carried by platform 22 so that the arm has its length aligned with a line perpendicular to the platform. The arm is movable vertically relative to the platform along this line. The arm is driven up or down relative to the platform by suitable drive mechanisms 28 which are carried by the platform. The drive mechanisms have a rack-and-pinion interface with the arm. That is, a portion of the arm adjacent each of two drive mechanisms 28 (one of which is shown in FIG. 2) defines a vertical rack which cooperates with a pinion gear driven by the respective drive mechanism. As shown in FIG. 4, arm 27 preferably is a trusswork structure similar to a LeTourneau leg for a jack-up platform as used in the offshore oil and gas drilling industry.

Arm 27 is shown in FIG. 1 in its raised position relative to the pipelaying ship. In this position of the arm, the lower end 29 of the arm is disposed substantially adjacent ship main deck 20. The arm is of sufficient length, and its vertical motion relative to platform 22 is sufficient that the lower end of the leg can be located sufficiently below the vessel as to be placed at a depth below ocean surface 17 where wave action on the water surface either has no effect or minimal effect upon an object suspended below the vessel. In pipelaying ship 10, arm 27 is capable of being positioned so that its lower end is located about 100 feet or more below the water surface.

Figure 4A:
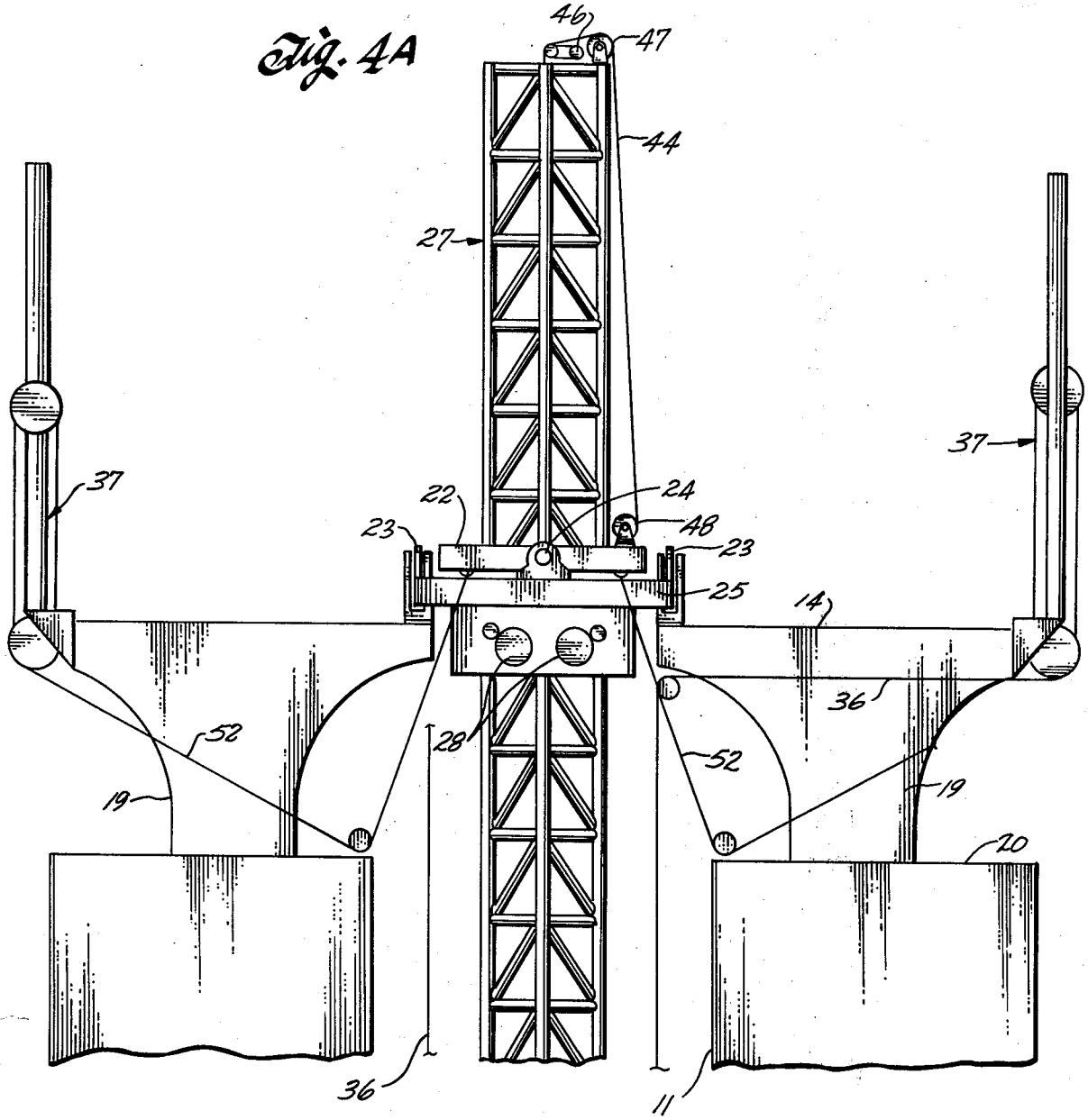
FIGS. 4A and 4B, taken together, are an enlarged cross-sectional elevation view of the pipelaying ship in the course of deploying or retrieving a diving bell to or from a subsea habitat employed in support of subsea pipelaying operations.
Figure 4B:
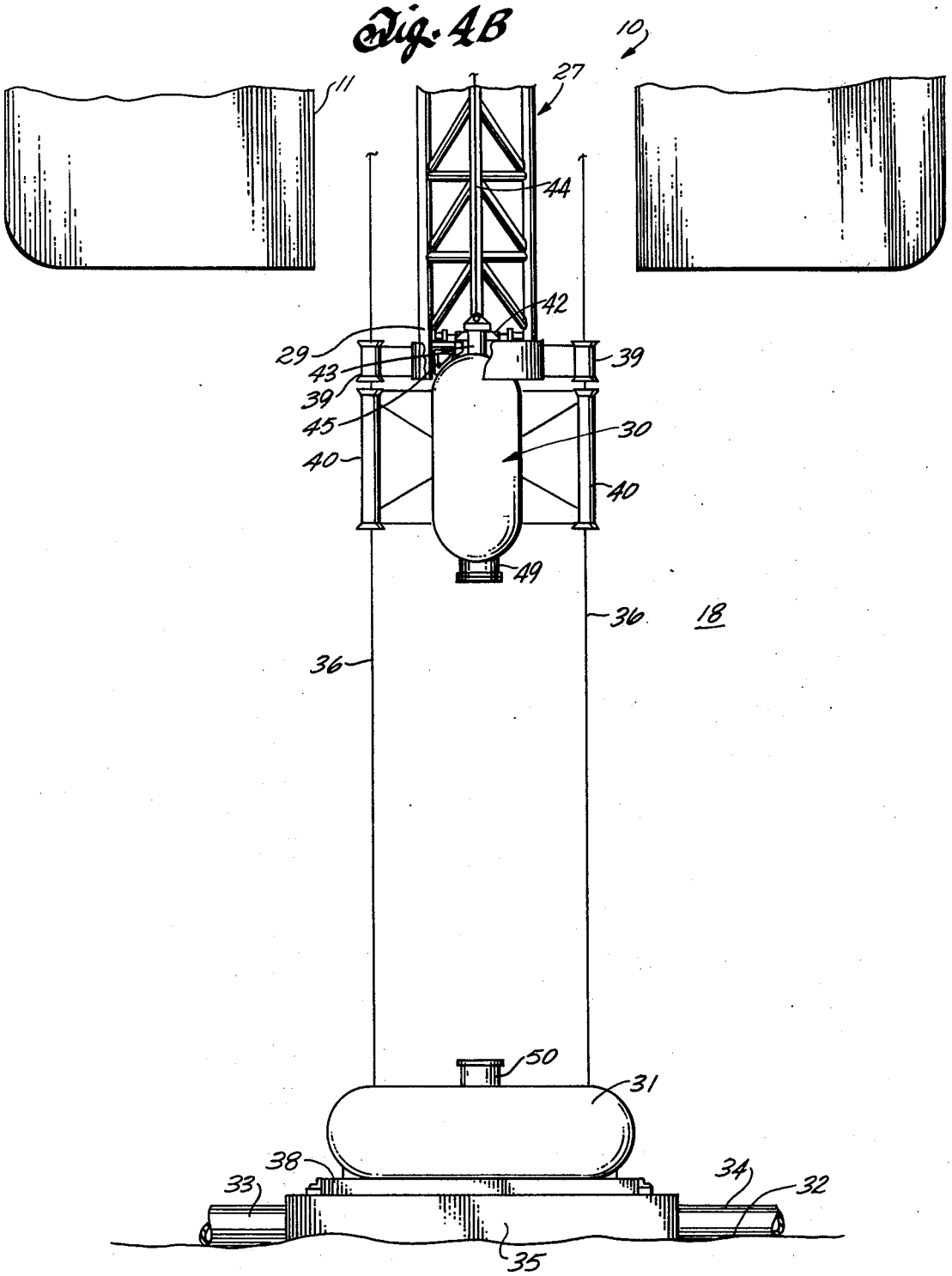

FIGS. 4A and 4B, taken together, show pipelaying ship 10 being used in the course of deploying or retrieving a submersible diving bell 30 to or from a subsea work habitat 31 disposed on the floor 32 of ocean 18. The habitat is located over and around the location where a welded connection to be made between the adjacent ends of two lengths 33 and 34 of subsea pipeline laid down from the pipelaying ship. Habitat 31 is landed from the pipelaying ship upon a base 35 into which pipeline sections 33 and 34 extend. The habitat is lowered from ship 10 to base 35 by cables 36 which, after mating of the habitat to its subsea base, are connected to suitable tensioning mechanisms 37 mounted to the ship, as shown in FIG. 4A. Mating of the habitat to its subsea base is accomplished via flat pad 38 carried by the habitat. As shown in FIG. 1, upon recovery of the habitat to the pipelaying ship, pad 38 mates around its periphery with the lower end of well 11 to form a watertight closure for the well.

The habitat cables 36 pass from the vessel through suitable guide tubes 39 carried by and disposed laterally from the lower end 29 of arm 27, and also through suitable guide tubes 40 supported by and disposed laterally of diving bell 30.

As shown in FIG. 4B, the lower end of arm 27 carries a selectively operable latching connector 42 which cooperates with a spindle 43 which projects upwardly from the upper end of bell 31. A cable 44 is connected to spindle 43 for raising and lowering the bell relative to the vessel. A compressible resilient bumper 45 is also carried by the lower end of arm 27 in association with connector 42 so that, when bell spindle 43 is engaged in connector 42, the bell is held substantially fixedly to the lower end of arm 27. Bell cable 44 extends upwardly through the center of arm 27 to and through a heave compensating mechanism 46 and to a crown block 47 at the upper end of the arm, and then to a suitable drawworks 48 which preferably is carried by platform 22.

Personnel can move between bell 30 and habitat 31 through cooperating closable trunks 49 and 50 carried by the lower end of the bell and the upper portions of the habitat, respectively.

The gimballed connection of arm 27 to vessel 10 is a variable stiffness connection which can be either entirely free, or rigid, or any intermediate condition desired. In pipelaying ship 10, this variable stiffness connection is provided by cables 52 which are connected to platform 22 and which are suitably reeved to cable tensioning mechanisms 37 carried by the ship itself. When no tension is applied to cables 52, platform 22 is free to move relative to the ship hull so as to assume and to maintain a stable attitude despite rolling or pitching motion of the ship in response to passing waves. However, as tension is gradually applied to cables 52 through the agency of tensioning mechanisms 37, the ability of the platform to move freely relative to the vessel is gradually constrained until ultimately the platform is effectively locked relative to the vessel so that the platform, and all structure carried by it, moves with the vessel as the vessel pitches and rolls, for example. If desired, this variable stiffness connection between the arm and the ship can be provided by suitable brakes or the like associated with gimbals 23 and 24 in the interface between platform 22 and foundation 19.

Assume that it is desired to lower the habitat to ocean floor 32 for the purpose shown in FIG. 4B, but that the conditions at ocean surface 17 are rough in that waves of sufficient height and period are running to cause the pipelaying ship to pitch, heave and roll appreciably. Under these conditions leg 27, with bell 30 locked thereto and habitat 31 held against the lower portion of the bell by suitable tension in cables 36, is lowered through vessel well 11 by operation of arm drive means 28. This is done while platform 22 is locked in position relative to the vessel. In this way the arm, the bell and the habitat may be safely lowered out of well 11 to a position below the ship. Because platform 22 is locked relative to the vessel as the arm is lowered (or raised), the arm cannot oscillate or swing relative to the vessel and thereby damage either the ship, the arm or any of the structure carried by the arm, especially at its lower end.

The arm is lowered until the bell and the habitat are disposed sufficiently below the vessel as to be either free of or only minimally subjected to dynamic displacing effects of surface wave action. This depth may be on the order of 100 feet below the water surface. At this point, the variable stiffness connection between the arm and the pipelaying ship is relaxed, preferably gradually, so that the arm becomes progressively free to assume and maintain a stable position irrespective of pitching and rolling motions of the pipelaying ship. In this manner, the lower end of the arm and the structure carried by it make the transition from having to follow pitching and rolling motions of the floating ship to the relatively undisturbed conditions which prevail at the desired water depth. It will be appreciated, however, that as the arm, the bell and the habitat are progressively lowered from the ship, they function progressively to damp the pitch and roll motions of the vessel. These damping effects are greatest upon the rolling motions of the pipelaying ship which are of greater angular amplitude than the pitching motions.

Once the arm has been lowered to the desired depth and the variable stiffness connection between the arm and the ship has been relaxed, the arm becomes free to assume a stable vertical attitude irrespective of motions of the ship due to wave action. This is possible because the location of the gimballed coupling of the arm to the ship preferably is at substantially the pitch and roll centers of the ship. Once the lower end of the arm has become stationary in the ocean, cables 36 are paid out from the ship to cause the habitat to be lowered into engagement with base 35. Preferably the mating of the habitat to the base is accomplished by operation of suitable releasable latches so that thereafter tensioning mechanisms 37 may be operated to apply tension to cables 36 without causing the habitat to be lifted from the ocean floor.

If personnel are then in the bell, they may then be lowered to the habitat by releasing connector 42 from bell spindle 43 and then lowering the bell along cables 36, which now function as guide cables.

If the nature of operations to be performed at the subsea location are extensive and it is necessary to change the personnel, they leave the habitat and enter the bell through closable trunks 49 and 50. The bell is then raised along guide cables 36 into association with the lower end of the arm which is in its lower position relative to the vessel. The guide cables assure that the bell has the desired attitude relative to the lower end of the arm as the bell approaches the lower end of the arm. Accordingly, spindle 43 is appropriately guided into the lower end of the arm so that connector 42 can be operated to fixedly secure the bell to the arm. In this process, bumper 45 acts as a shock absorber to protect the bell and the lower end of the arm from damage and to protect personnel in the bell from injury. The variable stiffness connection between the arm and the ship is then gradually stiffened until ultimately the arm is locked relative to the ship. In this manner, the arm and the bell are gradually brought into synchronism with the motions of the vessel, and the arm can thereafter safely be raised to its elevated position by operation of arm drive means 28.

Even though arm 27 in its lowered position can have a stable attitude relative to the ocean irrespective of pitch and roll motions of the vessel, the arm will still move vertically with the vessel as the vessel experiences heave motions. It is for this reason that heave compensator 46 is associated with bell cable 44. The heave compensator allows the bell to be brought smoothly and safely into or out of registry with connector 42, as desired.

Because deployment and retrieval of submersible objects such as bell 30 are made from and to the vessel at a substantial depth below the vessel to structure which is freely gimballed to the vessel at the time of such deployment or retrieval, it is apparent that this invention provides a system for more safely deploying and retrieving submersible objects from and to a vessel under substantially more adverse conditions than has been possible heretofore. Previously the subsurface structures to which the objects were connected were so mounted to the floating vessels as to move with the vessels in roll and pitch.

It will be appreciated that the present invention may also be used, with appropriate modifications in the structures described above, to deploy and retrieve self-propelled submersible vehicles from and to a floating surface ship. In such operations, it is preferred that one or two cables, similar to cables 36, extend below the bottom of the extended arm to a suitable suspended ballast mass. The cables provide a structure to which the submersible vehicle may connect for the purposes of proper positioning relative to the lower end of the arm prior to actual physical connection between the submersible vehicle and the arm.

Workers skilled in the art to which this invention pertains will appreciate that the preceding description of this invention has been presented with reference to only a single embodiment of the invention. The described embodiment is the embodiment which is presently preferred. It will be understood, however, that the present invention can be manifested in embodiments different from the described presently preferred embodiment. Thus, the preceding description sets forth the presently known best mode of practicing this invention, but certainly not all possible modes. Accordingly, workers skilled in the art to which this invention pertains will readily appreciate that modifications, alterations or variations in the arrangements and procedures described above may be practiced without departing from, and while still relying upon, the essential aspects of this invention.

What is claimed is:

1. Apparatus for deploying and retrieving a heavy submersible object from and to a floating vessel and comprising arm means carried by the vessel and movable relative to the vessel between a raised position and a lowered position in which the arm means extends vertically of the vessel to a point a selected distance below the vessel, gimbal means connecting the arm means to the vessel for enabling the arm means, at least in the lowered position thereof, to assume and to maintain a substantially stable attitude despite rolling and pitching motions of the vessel, latch means coupled to the arm means and cooperable with an object to be deployed or retrieved for coupling the object substantially fixedly to the latch means, lift means operable for raising and lowering the latch means and an object coupled to the latch means relative to the vessel from and to the lower extent of said selected distance, and snubbing means associated with the arm means and selectively operable for effectively securing the arm means from angular movement thereof relative to the vessel.

2. Apparatus according to claim 1 wherein the gimbal means includes a platform to which the arm means is mounted for movement between its raised and lowered positions, the platform having associated with it a line normal thereto, the arm means extending parallel to such line at least in the lowered position thereof.

3. Apparatus according to claim 2 wherein the latch means is movable along said line.

4. Apparatus according to claim 2 wherein the snubbing means is associated with the platform and is selectively operable between a first condition in which said line is substantially fixed relative to the vessel and a second condition in which said line and the platform with which it is associated are substantially fixed without regard to the vessel.

5. Apparatus according to claim 4 wherein the arm means is movable relative to the platform along said line between its lowered and raised positions, and the coupling of the latch means to the arm means is a fixed connection to the lower end of the arm means.

6. Apparatus according to claim 5 wherein the arm means consists of an elongate member of fixed length, and the lift means comprises means operable for raising and lowering the member along said line relative to the platform.

7. Apparatus according to claim 2 wherein the vessel has a passage vertically therethrough and the platform is disposed over the passage.

8. Apparatus according to claim 7 wherein the vessel has a pitch center and a roll axis, and wherein the platform is located substantially along the roll axis substantially at the pitch center.

9. Apparatus according to claim 1 including guide means for guiding an object to be deployed or retrieved into or out of registry with the latch means.

10. Apparatus according to claim 1 wherein the snubbing means is associated with the gimbal means.

11. Apparatus for deploying and retrieving a heavy submersible object from and to a floating vessel and comprising a platform on the vessel gimballed to the vessel for assuming and maintaining a substantially stable horizontal position in the presence of rolling and pitching motions of the vessel, object lifting arm means mounted to the platform and movable relative to the platform along a line normal to the platform between a lowered position of the arm means in which the lower end of the arm means is disposed a selected distance below the vessel and a raised position in which the lower end of the arm means is disposed at the vessel, guide means for guiding an object to be deployed or retrieved into or out of registry with the lower end of the arm means in the lowered position of the arm means, latch means carried by the lower end of the arm means cooperable with an object to be deployed or retrieved for coupling the object substantially fixedly to the lower end of the arm means, and snubbing means associated with the platform operable for effectively securing the platform from movement relative to the vessel.

12. A method for deploying and retrieving a submersible object from and to a floating vessel comprising the steps of (a) providing an object connector connectible with the object for supporting at least the immersed weight of the object, (b) providing on the vessel connector guide means for movement of the connector between a lowered position a selected distance below the vessel and a raised position substantially at the vessel, (c) mounting the guide means to the vessel so that the connector in the lowered position thereof can move freely in horizontal directions relative to the vessel so as to be positionally stable despite rolling and pitching motion of the vessel, (d) moving the connector toward and away from its lowered position with the object supported thereby while constraining the guide means to move with the vessel, (e) freeing the guide means from constraint to the vessel when the connector and the object are at the lowered position thereof so that the connector and the object become positionally stable, and (f) operating the connector to either release or engage the object, as appropriate for either deployment or retrieval of the object, while the connector is positionally stable at the lowered position thereof.

13. A method for deploying and retrieving a submersible object from and to a floating vessel comprising the steps of, for retrieval of the object, (a) disposing a selected distance below the vessel an object connector capable of supporting at least the immersed weight of the object and operable for releasably engaging the object substantially fixedly thereto, (b) providing a variable stiffness connection between the connector and the vessel, the connection having a first state in which the connection is sufficiently free that the connector can be positionally stable irrespective of vessel roll and pitch motions, and a second state in which the connection is sufficiently stiff that the connector follows substantially exactly vessel roll and pitch motions, (c) engaging the object to the connector while the connector is disposed said selected distance below the vessel and the connection is in its first state, (d) operating the connection from its first to its second state, and (e) raising the connector with the object engaged thereto to the vessel, the procedure for deploying the object from the vessel being substantially the reverse of steps (c), (d) and (e) above performed in substantially reverse order.

* * * * *